United States Patent [19]

Grasson

[11] 4,002,008

[45] Jan. 11, 1977

[54] COMPRESSION PACKAGING METHOD AND APPARATUS

[75] Inventor: John Louis Grasson, North Ridgeville, Ohio

[73] Assignee: Gould Inc., Rolling Meadows, Ill.

[22] Filed: Dec. 15, 1975

[21] Appl. No.: 640,560

[52] U.S. Cl. ..... 53/167; 53/124 CC; 29/208 R; 100/153

[51] Int. Cl.[2] ..... B65B 63/02; B65B 1/24

[58] Field of Search ..... 53/124 CC, 35, 59, 124 B, 53/124 C, 235, 167; 100/151, 152, 153, 154, 49; 29/200 A, 208 R

[56] References Cited

UNITED STATES PATENTS

| | | | |
|---|---|---|---|
| 1,911,682 | 5/1933 | Gardiner et al. | 100/153 |
| 2,718,992 | 9/1955 | Baker et al. | 53/124 B |
| 3,513,622 | 5/1970 | Timmerbeil | 53/59 R |
| 3,626,656 | 12/1971 | Langenscheidt | 53/59 R |
| 3,925,870 | 12/1975 | Adams | 29/200 A X |

*Primary Examiner*—Travis S. McGehee
*Assistant Examiner*—Horace M. Culver
*Attorney, Agent, or Firm*—Edward E. Sachs

[57] ABSTRACT

Packaging method and apparatus for positively nesting a plurality of individual pieces or articles in a nesting media for containerizing or storage. This nesting media comprises a base member of permanently deformable material such as cellular polystyrene. The individual pieces to be nested are initially placed on the upper surface of the base member in a desired oriented position relative to each other. Thereafter, the base and pieces are conveniently moved along a work path which includes a movable force member disposed thereabove over a portion thereof. As the base member is moved beneath the force member, the force member is moved toward the work path and base member a distance sufficient to engage the pieces or articles and force them at least partially into the base, thus creating the nested relationship between them. The force member is then moved away from the work path and base member in preparation for receiving another base member with pieces or articles positioned therein. If desired, the base member may be placed in an opened top container, packaging tray or other convenient packaging means prior to the nesting operation.

9 Claims, 9 Drawing Figures

COMPRESSION PACKAGING METHOD AND APPARATUS

BACKGROUND OF THE INVENTION

This application pertains to the art of packaging and more particularly to nesting individual pieces or articles in a base or pad member.

The invention is particularly applicable to nesting large bearings of the type employed in engines in a base member for subsequent packaging and will be described with particular reference thereto; however, it will be appreciated by those skilled in the art that the invention has far broader applications and may be equally employed with innumerable other articles, pieces or the like where nesting of the pieces in a base member is acceptible and practiced.

Heretofore, the packaging of engine bearings has been done by hand and has then required use of special cartons and dunnage specially designed for separating, cushioning, covering and so on the engine bearings being packaged. For some bearing sizes and styles, the dunnage required to effect an acceptable packing arrangement merely comprised cardboard separators and the like while for other bearing sizes and styles the dunnage required comprised foam rubber pads and the like.

In any event, the disadvantages of these prior hand packing methods have been in the fact that the individuals who do the packing pace the production or packing capacity. Because of hand packing, the overall packaging operation is deemed comparatively slow and thus rather expensive insofar as labor costs are concerned. Furthermore, the cost of the dunnage that goes into a given package is extremely high, not only in the cost of material but also in the cost of housing and/or storage therefor.

There is also a good deal of special design work required by packaging engineers each time there is a change or modification in any given package. This results in a change in the work standards which then require the services of an industrial engineer. Such indirect labor costs and undertakings further increase the overall costs of the packaging operation. Finally, hand packing for engine bearings and the like requires an inordinate amount of floor space which could otherwise be placed to better and more productive use.

Accordingly, it is deemed desirable to eliminate the necessity for hand packaging operations and to substantially perform such operations automatically. In this regard, it is considered particularly desirable that all container handling be done automatically by machine and that human operators merely institute the initial packing process by loading the machine. Such apparatus and method of packaging would result in the reduction of the total number of operators required to package the same production output, eliminate the need for at least some of the dunnage required in present manual packing procedures and reduce floor space required for the packing operation.

The present invention contemplates a new and improved method and apparatus which overcome all of the above referred to problems and others and provides a new method and apparatus for packaging which at least meets the above defined desirable features for an automated packaging system. The new method and apparatus are also simple, economical and readily adapted to use in a plurality of environments for packaging any number of different pieces or articles.

BRIEF DESCRIPTION OF THE PRESENT INVENTION

In accordance with the present invention, there is provided a method of nesting a plurality of individual pieces or articles in a base member for shipping and storing. Accordingly, the first step is providing a base member constructed of a low density, permanently deformable material wherein the base has opposed and spaced apart top and bottom faces. The next step requires placing the individual pieces or articles on the base member top face in a desired oriented position relative to each other so that at least a portion of each piece is engaging the top face. The final step requires applying a force against the pieces in a manner to move them at least partially through the base member from the top face toward the bottom face whereby permanent recessed nesting areas are formed in the base member for each of the pieces or articles.

In accordance with another aspect of the present invention, the method further includes the step of passing the base member with the pieces thereon along a predetermined work parth at least following the step of placing.

In accordance with another aspect of the present invention, the step of applying comprises selectively moving a force member or surface from a first non-contacting to a second contacting position so as to engage the pieces at least as the base member and pieces move along a portion of the work path.

In accordance with yet another aspect of the present invention, apparatus is provided for nesting a plurality of individual pieces or articles on a base member comprised of permanently deformable material for shipping or storing the pieces and wherein the pieces are initially merely placed on the top surface of the base member. The apparatus includes means for defining a lower work path extending between initial and final positions and adapted to support the base member. Means are provided for moving the base member along the lower work path between the initial and final positions and for defining an upper work path spaced generally vertically from and parallel to the lower work path. Also provided are means for altering the transverse distance between the upper and lower work paths between a first normal position and a second working position. In the second position, the spacing between the paths and the combined initial height of the pieces and base member are such that the pieces will be engaged by the upper work path and forced into the base member so as to create substantially permanent piece nesting areas.

In accordance with another aspect of the present invention, the upper and lower work path are defined by upper and lower conveyor means. The upper work path as defined by the upper conveyor means extends only over a portion of the length of the lower work path as defined by the lower conveyor.

The principal object of the present invention is the provision of method and apparatus for packaging by nesting pieces or articles in a deformable base member.

Another object of the present invention is the provision of method and apparatus for packaging which are simple, which reduce labor and material costs and which reduce the floor space required for an effective overall packaging operation.

Still another object of the present invention is the provision of method and apparatus for packaging which are readily adapted to use in any number of environments for any number of types and styles of pieces or articles.

BRIEF DESCRIPTION OF THE DRAWINGS

The invention may take physical form in certain parts and arrangements of parts, a preferred embodiment of which will be described in detail in this specification and illustration in the accompanying drawings which form a part hereof and wherein.

DESCRIPTION OF THE PREFERRED EMBODIMENT OF THE INVENTION

Figure 1:
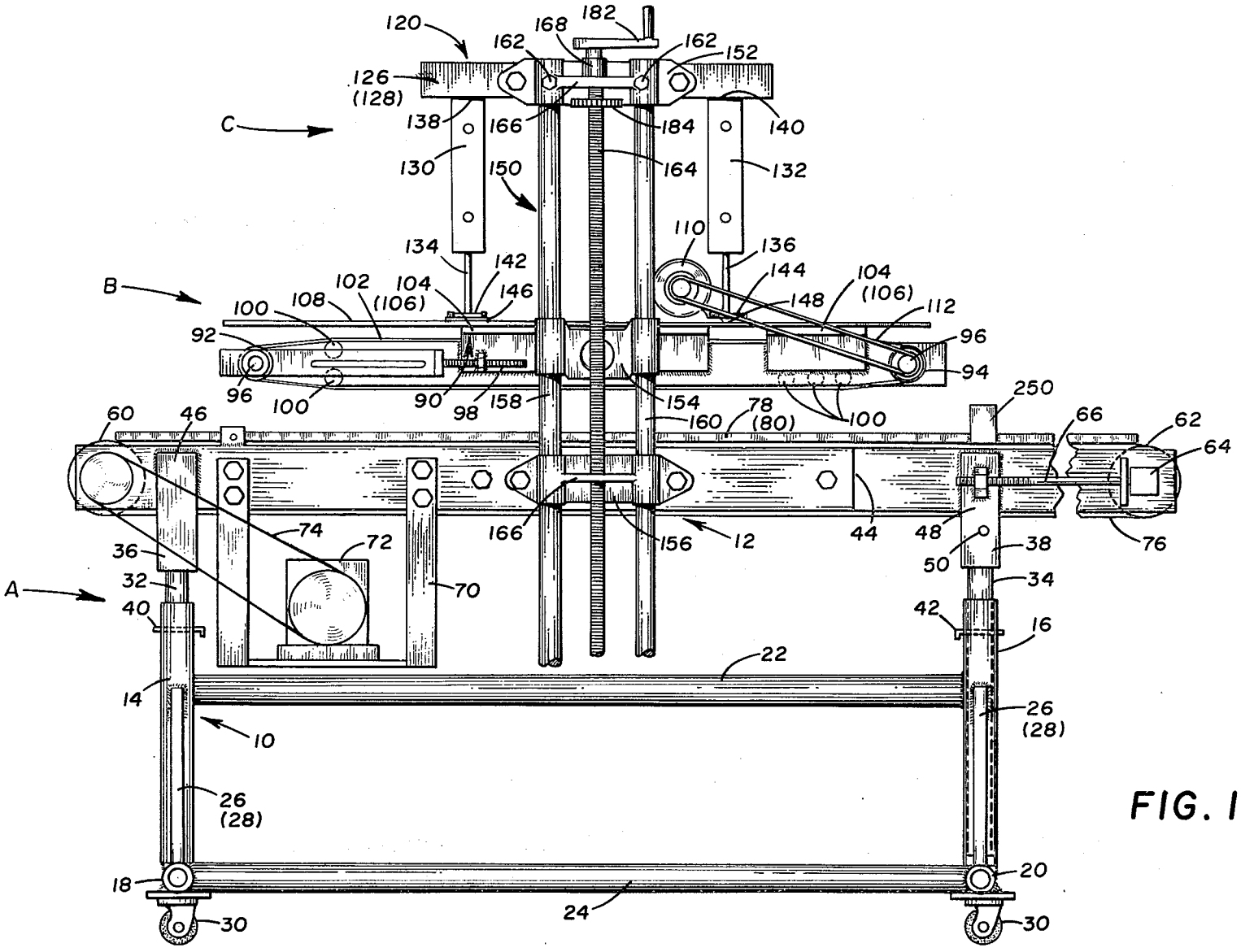
FIG. 1 is a side elevational view showing the overall apparatus employed in practicing the concepts of the present invention.

Referring now to the drawings wherein the showings are for purposes of illustrating the preferred embodiment of the invention only and not for purposes of limiting same, the FIGS. show a lower conveyor assembly A, an upper conveyor assembly B and a power or compression assembly C.

Figure 3:
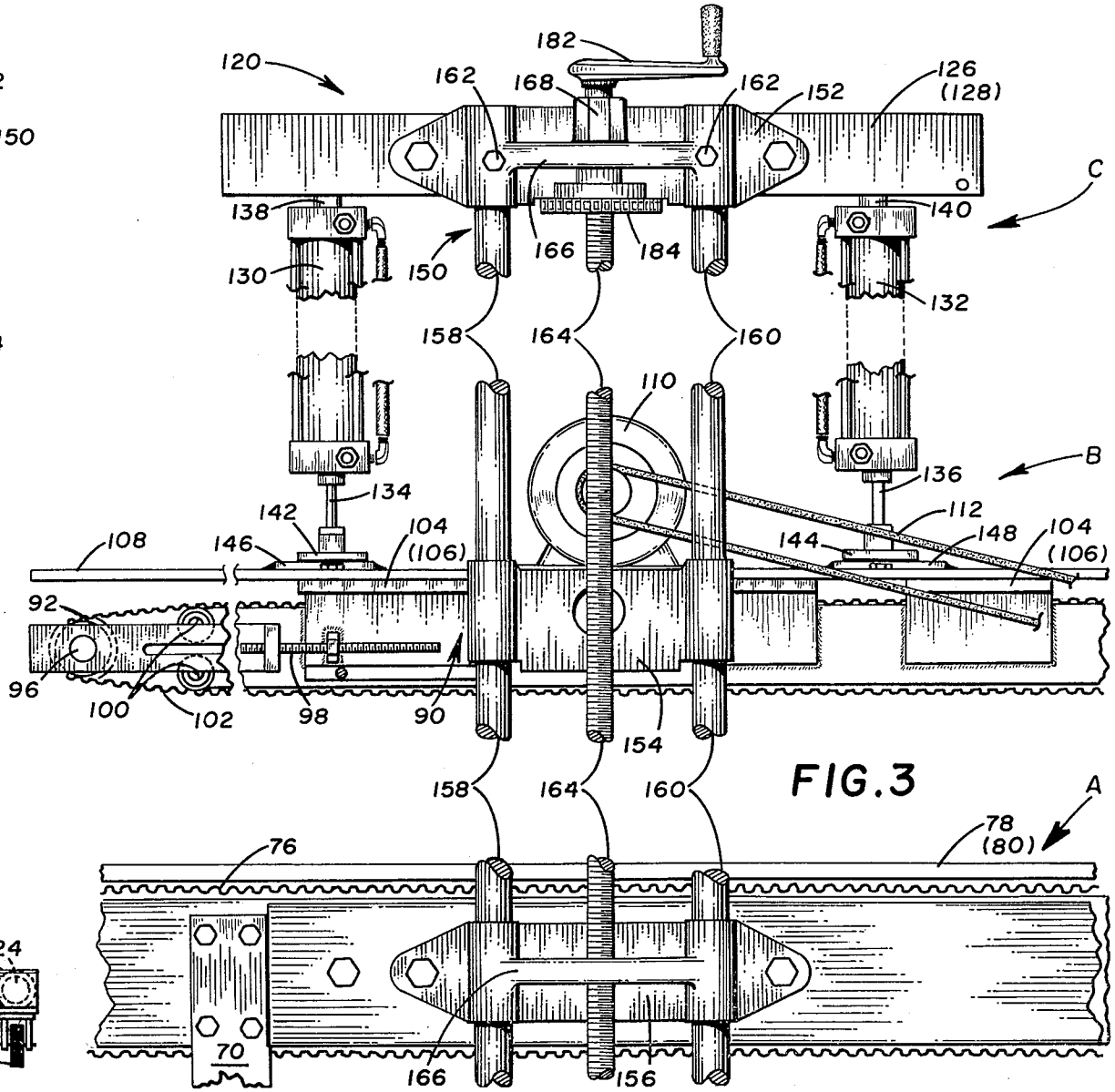
FIG. 3 is an enlarged view of a portion of the apparatus shown in FIGS. 1 and 2.
Figure 2:
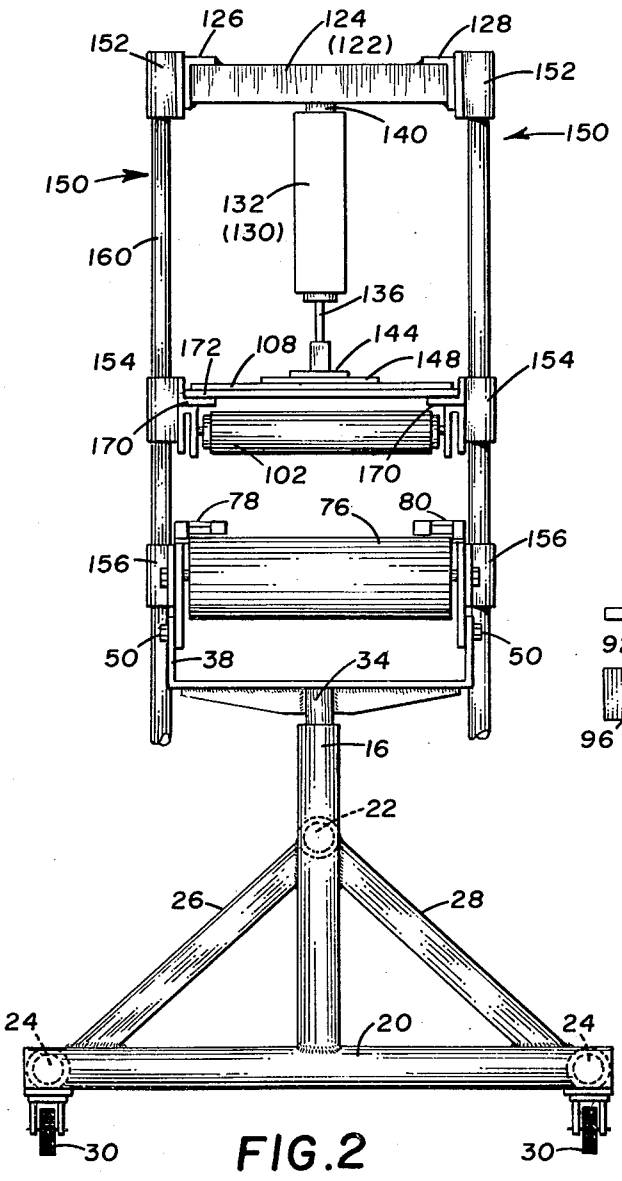
FIG. 2 is an end view of the apparatus shown in FIG. 1.

More specifically and with particular reference to FIGS. 1, 2 and 3, assembly A defines a lower work path and is comprised of a frame portion generally designated 10 and a conveyor portion generally designated 12. The frame portion includes a pair of spaced apart vertically disposed hollow leg members 14,16 having a pair of spaced apart generally horizontal leg members 18,20. Advantageously, conventional castors generally designated 30 may be included at the outermost ends of both horizontal leg members 18,20. Vertical extension members 32,34 are conveniently received in hollow leg members 14,16, respectively, and these extension members each include generally U-shaped yoke structures at the uppermost end thereof generally designated 36,38. Members 14,32 and 16,34 each include through holes which may be placed in registry with each other to receive handles 40, 42 for permitting vertical adjustment of conveyor portion 12 as is known.

The structure of frame 10 described above is merely the preferred arrangement for the present invention. The components of this structure are made of steel and steel tubing or pipe which are conveniently welded to each other for ease and rigidity of construction. Many other frame structures could also be advantageously employed, however, without departing from the intent or scope of the invention.

Conveyor portion 12 is generally comprised of an elongated channel member 44 having spaced apart channel supports 46,48 on each side thereof. As will be particularly noted from FIGS. 1 and 2, these channel supports are dimensioned and mounted so as to register with yokes 36,38 and may be affixed to the yokes by any convenient means such as, for example, the conventional nut and bolt arrangements generally designated 50. Disposed at opposite ends of channel member 44 are rolls 60, 62 which are mounted for rotation at their ends by conventional pillow blocks generally designated 64. Associated with the pillow blocks used in mounting roll 62 and channel member 44 are conventional adjustment means generally designated 66 to facilitate control of tension on the conveyor belt.

Depending downwardly from channel member 44 adjacent the end thereof having roll 60 is a framework structure generally designated 70 which receives and houses an electric drive motor generally designated 72. This motor is of the variable speed type for reasons and purposes which will become apparent hereinafter. A drive chain designated 74 operably interconnects the motor and roll 60 by conventional sprocket means. While not shown in the drawings, a chain guard may be conveniently received over the chain for safety reasons.

A conveyor belt generally designated 76 extends in a continuous manner around rolls 60, 62 with the upper surface thereof being supported between the rolls by channel member 44. In the preferred arrangement of the invention, belt 76 is comprised of a wire mesh belt and motor 72 may be operated at speeds of up to 80 rpm. Extending longitudinally along the top of belt 76 are guide rails 78, 80 which conveniently guide workpieces along the conveyor from one end to the other. These guide rails are constructed such that the transverse distance between them may be readily adjusted to accommodate different workpiece sizes.

The overall structure of lower conveyor A hereinabove described is deemed to be fairly conventional in nature and the specifics of the construction described are merely directed to the preferred arrangement contemplated.

Upper conveyor assembly B defines an upper work path and includes a conveyor frame generally designated 90 having end rolls 92,94 at opposite ends thereof which are conveniently end mounted to the conveyor frame by conventional pillow blocks 96. Similar to the arrangement of lower conveyor, adjustment means generally designated 98 are operably connected to end roll 94 and the conveyor frame for adjusting conveyor belt tension. Disposed between rolls 92,94 are a plurality of idler rolls generally designated 100. In the preferred embodiment of the present invention, these idler rolls have a smaller diameter than end rolls 92,94. It is contemplated that five such idler rolls will be evenly distributed along the upper surface of frame 90 and that 24 such rolls will be evenly distributed along the lower surface of frame 90 although other numbers of rolls could also be employed. Lower idler rolls 100 exert a uniform pressure on those pieces or articles being packaged as will hereinafter be described in greater detail.

A conveyor belt generally designated 102 extends continuously around end rolls 92,94 which, in the preferred embodiment, comprises a synthetic composition belt. Side brackets generally designated 104,106 are rigidly affixed to opposite sides of frame 90 for purposes of mounting the upper conveyor to the remainder of the apparatus as will hereinafter become apparent. A drive plate 108 which is substantially the same length and slightly wider than the upper conveyor is rigidly affixed to the conveyor at side brackets 104, 106 by convenient means such as conventional nuts and bolts. A variable speed electric drive motor 110 is mounted to drive plate 108 and by a drive chain 112 is conventionally operably connected to end roll 94.

The power or compression assembly C is operably interconnected to upper conveyor assembly B. This assembly includes a rectangular frame generally designated 120 having spaced apart end members 122,124 and side members 126,128. Force means in the form of power cyclinders 130,132 having cylinder rods 134,136 are operably connected between frame 120 and drive plate 108. To this end, upper mounting brackets 138, 140 connect the uppermost ends of cylinders 130, 132 respectively to end members 122, 124 of the frame and lower mounting brackets 142, 144 connect cylinder to drive plate 108. The means for such interconnections are deemed conventional and, therefore, are not described in greater detail herein. In the preferred embodiment the power cylinders comprise pneumatic cylinders and the operation thereof will be described in detail hereinafter.

A mounting and vertical adjustment assembly 150 is mounted on each side of the apparatus for properly interconnecting lower conveyor assembly A, upper conveyor assembly B and power assembly C and to permit proper relative adjustment therebetween. Inasmuch as the two assemblies 150 are identical, only one such assembly will be described in detail herein, it being appreciated that the other assembly is identical thereto unless otherwise specifically noted. Accordingly, each assembly 150 includes a rod receiving and guide bracket 152 rigidly affixed to one of side members 126, 128 of frame 120; a rod receiving and guide bracket 154 rigidly affixed to one of the sides of frame 90 of upper conveyor assembly B; and a rod receiving and guide brackets 156 rigidly affixed to one of the sides of channel member 44.

Brackets 152, 154 and 156 are placed in vertical alignment with each other and spaced apart elongated steel rods 158, 160 are received thereby. Relative sliding movement is permitted between rods 158, 160 and brackets 154, 156 and the rods are maintained stationary in brackets 152 by any convenient means as, for example, set screws generally designated 162. In addition, an elongated threaded rod 164 extends between and is threadedly received in brackets 152, 156 in base or gusset areas generally designated 166. A lock nut 168 is provided on threaded rod 164 at rod receiving and guide bracket 152 in a known manner to lock the apparatus components in a particular desired spacial relationship following adjustment. Extending inwardly toward each other from each bracket 154 are supporting ears 170 which receive, support and are affixed to the opposite ends of a support member 172 which is also rigidly affixed to drive plate 108.

Figure 4:
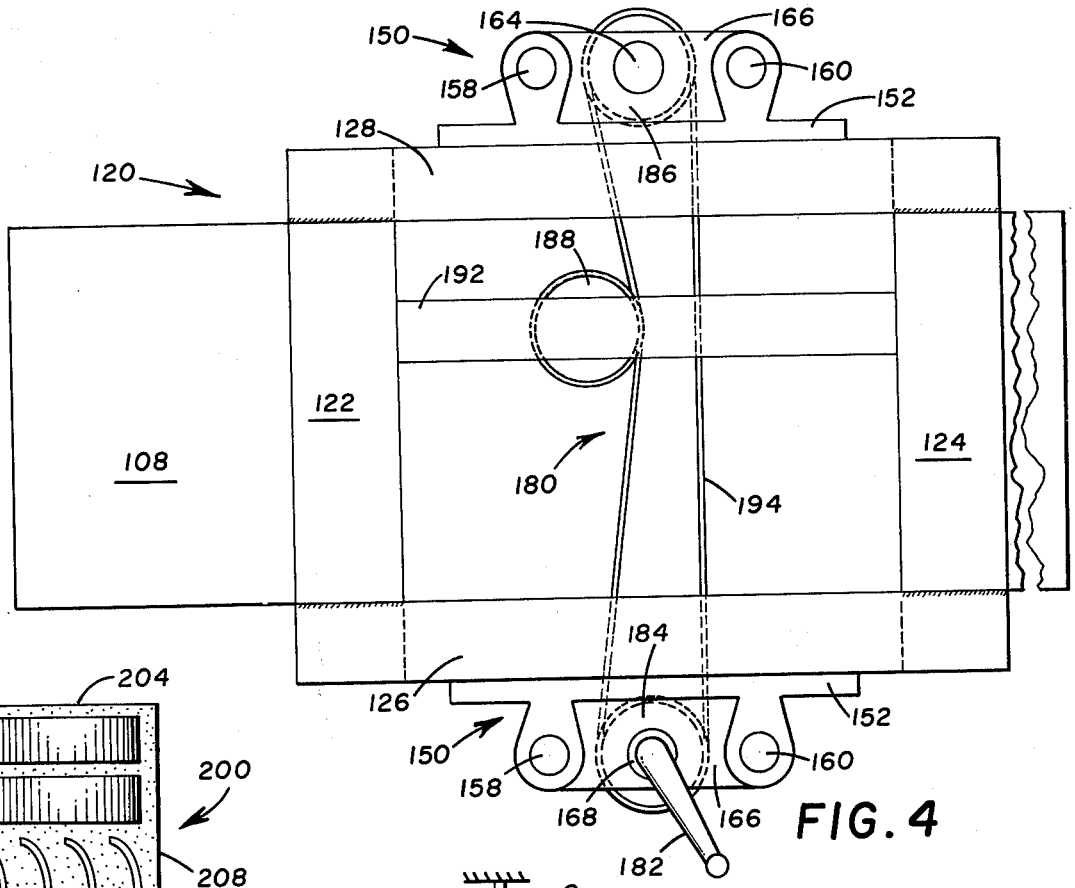
FIG. 4 is a plan view of a portion of the apparatus showing the means provided for adjusting the relationship between certain operative components of the apparatus.

With particular reference to FIG. 4, description will hereinafter be made with references to the adjustment assembly generally designated 180 which permits adjustment of the relative transverse distance between upper conveyor assembly B and lower conveyor assembly A. Specifically, a hand crank 182 is received on the uppermost end of one of the elongated threaded rods 164. Sprockets 184, 186 are rigidly mounted to the elongated threaded rods and both of these sprockets have an equal amount of teeth. An idler wheel 188 is conveniently adjustably mounted on a cross member 192 to maintain the desired tension on a chain 194 which extends continuously around sprockets 184, 186. Thus, as crank 182 is turned in one direction or the other to turn the associated threaded rod, the interconnected sprockets act so that both rods 164 rotate in unison in order that the upper conveyor assembly B and power or compression assembly C may be moved as a single unit toward and away from lower conveyor assembly A. Since power cylinders 130, 132 have a constant stroke, such adjustment is important to facilitate apparatus use with any number of different pieces or articles which are to be packaged in accordance with the concepts of the present invention.

The apparatus as thus far described and when in normal use merely comprises a portion of an overall packaging line. The electrical wiring for the conveyors themselves as well as the pneumatic piping for cylinders 130, 132 is conventional and convenient circuitry is provided in order that the apparatus will function as disclosed hereinafter. The specifics of such circuitry do not form a part of the present invention and, therefore, are not disclosed in detail in this application.

Figure 5:
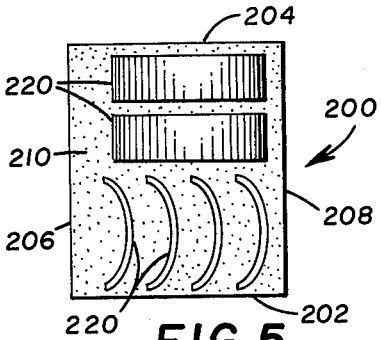
FIG. 5 is a plan view of a typical packaging arrangement prior to processing through the apparatus.

FIG. 5 shows a package of the type typically processed when practicing the concepts of the present invention. The package includes a base or pad member generally designated 200 which, in the preferred embodiment, is comprised of a block of multi-cellular polystyrene foam. The preferred material for this purpose is foamed polystyrene having closed cell walls. Such materials are well known in the art and can be produced by extension-expansion of polystyrene. This material is preferred because of its light weight and its physical properties which permit it to be permanently deformed in certain areas while not causing cracking or destruction to the entire pad. However, in some instances, other materials for base 200 could also be advantageously employed while not departing from the intent or scope of the present invention. The base includes opposed side walls 202, 204, opposed end walls 206, 208, a top face 210 and a bottom face surface 212. In the preferred embodiment, a plurality of semi-circular bearing halves or segments 220 are shown as having been placed in the desired spaced apart relationship relative to each other on top face 210.

Adjustment assembly 180 is then employed so that by means of crank 182 and elongated threaded rods 164, the upper conveyor assembly B and power or compression assembly C may be adjusted to the desired height. This height is such that when cylinders 130, 132 are in their retracted position, conveyor belt 102 will not engage bearings 220 on base or member 200 as they are passed beneath that conveyor belt on conveyor belt 76. Further, the proper height is such that when cyclinders 130, 132 are in their extended position, belt 102 will engage bearings 220 to force them at least partially into the base member from top face 210 toward bottom face 212. The proper adjustments, therefore, depend upon the thickness of the base member as well as the height that bearing members 220 extend upwardly from top face 210.

For purposes of facilitating automatic operation, a photoelectric cell 250 is disposed along lower conveyor assembly A closely adjacent the lead end of upper conveyor assembly B. This photocell is interconnected with the remainder of the apparatus circuit for automatically controlling operation of at least power or compression assembly C in a manner which will become apparent hereinafter.

Figure 6:
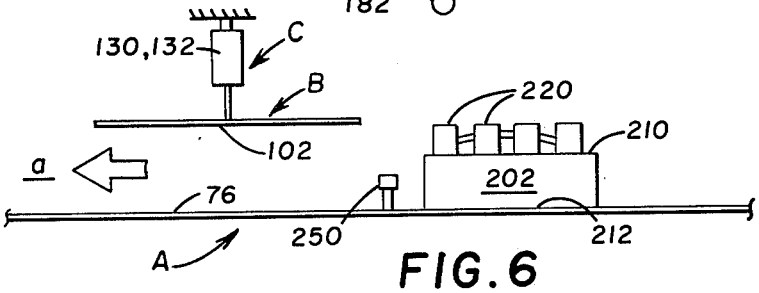
FIGS. 6–8 are schematic views showing the basic method steps employed in practicing the concepts of the invention; and, FIG. 9 shows an alternative packaging arrangement for processing through the apparatus.
Figure 7:
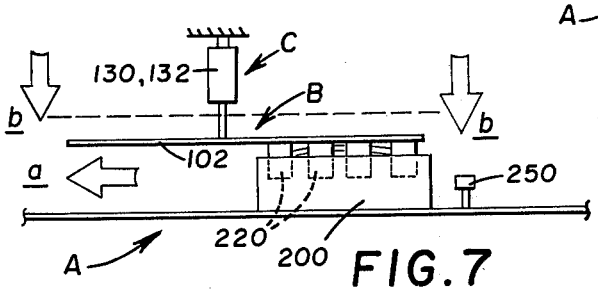
Figure 8:
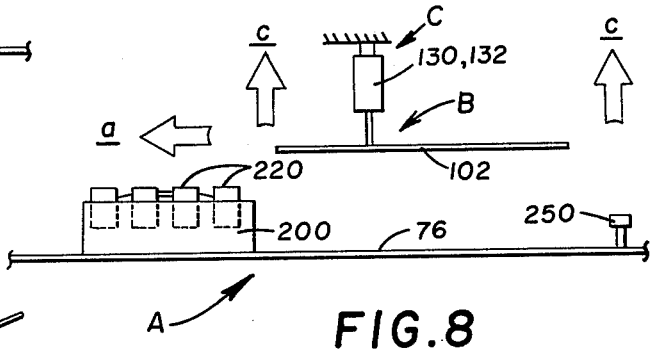

With particular reference to FIGS. 6, 7 and 8, the apparatus and method of the subject invention are shown in schematic. In the FIGS., conveyor belts 76, 102 are driven in the same direction and at the same speed. The same speed for both conveyor belts is in order that the method and apparatus will function as desired without tearing or destroying the base member during piece or article nesting therein. Inasmuch as the conveyors are driven by variable speed motors, conveyor speed adjustments for particular applications are rather easily effected. Base or pad member 200 having bearing halves 220 properly positioned thereon is placed at an initial position on belt 76 of lower conveyor assembly A so that it will be carried by the belt in direction *a*.

Side or guide rails 78, 80 are adjusted on the lower conveyor assembly so that they will closely guide the base member longitudinally along the conveyor.

As the base member passes through the path of light from photocell 250 as shown in FIG. 7 the circuitry in the apparatus is energized. By suitable timers, and knowing the speed of the conveyors, cylinders 130, 132 are not energized until the entire base member is beneath upper conveyor assembly B. Following that time interval, power cylinders 130, 132 are energized to move from their retracted to their extended positions to move upper conveyor assembly B in the direction of arrows *b* from the initial phantom line position to the solid line position as shown in FIG. 7. As the upper conveyor is moved in the direction of arrows *b*, conveyor belt 102 engages bearing halves 220 on the base member to force the members at least partially into the base from top face 210 toward bottom face 212. As noted above, belt 102 moves in the same direction and at the same speed as belt 76 so that the apparatus will not damage or destroy the base member as it is passed through the apparatus. The position of the bearing halves following such forcing is shown in dotted lines in FIG. 7. During this aspect of apparatus operation, the conveyors themselves continue to move in the direction of arrow *a* to convey the base member toward a final position.

As the base member approaches the end of the total common length between upper and lower conveyor assemblies A and B, another timer causes cylinders 130, 132 to retract so that upper conveyor assembly B is moved in the direction of arrows *c* in FIG. 8 back to its initial position. Thereafter, the base member may continue along the lower conveyor assembly on conveyor belt 76 to a final position and other work stations for final packaging and/or storage. In addition, the nesting apparatus is then ready for processing still another base member which includes the bearing valves properly positioned thereon.

The apparatus and method hereinabove described provides positive nesting of bearing halves 220 into base member 200. Once nesting has been completed, it is possible to place the base member and bearings in containers or boxes for shipping or storage. It is also possible to place the base member and bearings on trays or the like to be covered by, for example, plastic bubble-type packaging. The actual type of final packaging involved may be widely varied and will depend, to a great extent, on the actual pieces or articles being processed.

Figure 9:
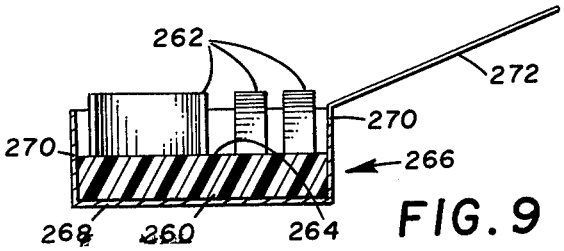

In the event, however, it is desired to package the bearing halves or segments in a box type container, the base member may be placed in the container prior to the time the base member is passed through the apparatus for nesting the pieces therein. FIG. 9 shows a cross-sectional view of such an arrangement prior to the time it is processed through the apparatus. Here, base member 260 is employed with parts or bearing segments 262 disposed on top face surface 264 thereof. The pieces and base member are placed in a box-type container generally designated 266. Such a container is conventionally made from cardboard or the like and includes a bottom wall 268, continuous upstanding side wall portions 270 and a top flap or cover 272 hinged to one of the side wall portions. As will be noted, the uppermost portions of parts 262 extend outwardly beyond the upper distal ends of side walls 270 in order that the nesting operation will not interfere with or ruin the container. Top flap or cover 272 is such that it will not be crushed as the upper conveyor assembly is moved from its retracted position into the extended position for forcing parts 262 into a nested condition in base member 260.

As should be readily appreciated, and while the concepts of the present invention have been described with reference to packaging engine bearing segments, the concepts are also readily adaptable to use in any number of environments for processing or packaging any number and types of pieces, parts or articles. Moreover, the concepts of the subject invention facilitate many and varied final forms of packaging for such pieces, parts or articles once or as they are nested in the base member. Although the initial heights of the individual bearing segments 220,262 shown in FIGS. 5, 6 and 9 are the same, the initial heights may be varied within limits as long as the height differential is such that the base member has a sufficient thickness between the top and bottom faces to absorb the differential during the nesting operation. This aspect is deemed important when the pieces, parts or articles to be packaged on a common base member are of different sizes or styles or where they cannot be originally positioned on the upper face of the base member so the uppermost portions are at equal heights from the upper face.

The particular controls employed for permitting operation of the apparatus as disclosed hereinabove may also be many and varied. Inasmuch as the controls themselves do not form a part of the present invention, they have not been described in detail herein. Persons skilled in the art will readily appreciate the many and varied means by which desired control for the apparatus may be achieved. In some instances, it may be necessary to vary apparatus operation from that described with reference to the preferred embodiment for purposes of accommodating the different types of pieces or articles to which the concepts of the present invention may be adopted.

The invention has been described with reference to the preferred embodiment. Obviously, modifications and alterations will occur to others upon the reading and understanding of the specification. It is intended that all such modifications and alterations will be included insofar as they come within the scope of the appended claims or the equivalents thereof.

Having thus described my invention, I now claim:

1. Apparatus for nesting a plurality of individual pieces in a base member which is comprised of a permanently deformable material having a predetermined thickness wherein said pieces are initially placed on the top face of said base member and forced thereinto from said top face toward the bottom face, said apparatus comprising:

a first conveyor having a first generally flat conveyor surface defining a lower work path extending between an initial position and a final position adapted to support said base member with said pieces thereon, said first conveyor including means for continuously moving said first conveyor surface with said base member and pieces thereon from said initial to said final position at least during a nesting operation;

a second conveyor having second generally flat conveyor surface defining an upper work path spaced generally vertically from and extending generally parallel to said lower work path between an initial and a final position, said second conveyor including means for continuously moving said second conveyor surface from said initial to said final position at least during a nesting operation;

means for altering the transverse distance between said upper and lower work paths between a first normal position with said upper work path spaced from said lower work path a distance greater than the initial combined height of said base member with said pieces placed on the top face thereof and a second working position with the spacing between said paths being less than said initial combined height but greater than the height of said pieces such that said pieces will be engaged by said second conveyor surface and forced into said base member from said top face toward said bottom face to create substantially permanent nesting areas for said pieces; and means for selectively controlling operation of said altering means such that as said base member and pieces pass beneath said upper work path initial position said altering means moves said work paths from said first to said second position and as said base members and pieces are moved to said upper work path final position said work paths are moved from said second back to said first position, said base member and pieces being continuously moved between said work paths at least between said upper work path initial and final positions.

2. The apparatus as defined in claim 1 further including means for selectively adjusting the distance between said upper and lower work paths when said paths are in said first and second positions.

3. The apparatus as defined in claim 2 wherein said adjusting means comprise mechanical adjustment assemblies extending between said first and second conveyors adjacent the sides thereof.

4. The apparatus as defined in claim 3 wherein said adjustment assemblies comprise elongated guide members extending between and communicating with said first and second conveyors and elongated threaded adjusting members threadedly engaging said conveyors, rotation of said adjusting members causing said first and second conveyors to be moved transversely of each other.

5. The apparatus as defined in claim 1 further including means for sensing the position of said base member on said lower work path as said base member is moved from said initial toward said final position.

6. The apparatus as defined in claim 1 wherein said first and second conveyors comprise continuous belt type conveyors, said upper work path as defined by said second conveyor extending over only a portion of the length of said lower work path as defined by said first conveyor.

7. The apparatus as defined in claim 6 wherein said altering means comprises force means operably connected to said second conveyor for moving said second conveyor between said first and second positions.

8. The apparartus as defined in claim 7 including moving means for moving said first and second conveyor surface in the same direction along said upper and lower work paths, at least one of said first and second conveyors including means for adjusting the speed of movement of the associated conveyor surface.

9. The apparatus as defined in claim 7 wherein said force means comprises power cylinder means.

* * * * *